United States Patent [19]

Guenther

[11] 4,136,898

[45] Jan. 30, 1979

[54] COMBINATION DOOR HANDLE AND SAFETY LOCKING DEVICE

[76] Inventor: Karl H. Guenther, P.O. Box 195, Colden, N.Y. 14033

[21] Appl. No.: 852,473

[22] Filed: Nov. 17, 1977

[51] Int. Cl.[2] ..... E05C 5/02

[52] U.S. Cl. ..... 292/57; 292/244

[58] Field of Search ..... 292/57, 60, 62, 67, 292/69, 244, DIG. 61, DIG. 65

[56] References Cited

U.S. PATENT DOCUMENTS

| | | | |
|---|---|---|---|
| 2,529,009 | 11/1950 | Foss | 292/57 X |
| 2,565,752 | 8/1951 | Bjelland | 292/62 |
| 2,793,062 | 5/1957 | Fleming | 292/57 |
| 3,891,253 | 6/1975 | Revell | 292/59 |

FOREIGN PATENT DOCUMENTS

| | | | |
|---|---|---|---|
| 810117 | 5/1951 | Fed. Rep. of Germany | 292/67 |
| 13981 | 5/1925 | Netherlands | 292/62 |
| 125159 | 6/1949 | Sweden | 292/60 |

*Primary Examiner*—Thomas J. Holko

[57] ABSTRACT

A combination door handle and locking device comprising a handle portion having a stem rotatable and slidable in a lock housing. A coil spring on the stem maintains pressure on the locking portion. At least one striking plate and adjacent keeper slot is provided on one end of the housing, and preferably two are provided, one on each end. A leaf spring adjacent the keeper slot applies pressure to the locking portion while it is in a closed position.

11 Claims, 3 Drawing Figures

COMBINATION DOORHANDLE AND SAFETY LOCKING DEVICE

BACKGROUND OF THE INVENTION

The present invention relates to door and drawer locking mechanisms, more particularly to cabinet doors and/or drawers, preventing easy access by infants and toddlers.

Existing cabinet door and drawer mechanisms and latching devices, are usually of a magnetic latch or spring tension roller and wedge device, to hold doors or drawers closed. The prior art devices have generally proven to be inadequate and an easy access for infants and toddlers resulting in many injuries and even death in some instances.

Therefore, a need exists for an inexpensive, easy to install, safety lock for cabinet doors and drawers to keep infants out of doors and drawers where medicine, household cleaning materials and other dangerous items are stored.

SUMMARY OF THE INVENTION

The present invention provides a new, useful and inexpensive safety lock. It is unique in several ways.

A. It prevents toddlers and infants from opening cabinet drawers where dangerous household items are stored. The lock is designed with three (3) definite motions.

1. A downturn of the door knob.
2. A definite push against a coil spring to override the locking mechanism.
3. And a final upturn of the knob to bring the locking bar into a vertical position on (door), a horizontal position on (drawers) which will allow you to open doors and/or drawers.

B. The present invention is also unique in its simple way to lock doors and drawers. The locking of doors and drawers is accomplished simply by turning the knob, which operates the locking bar, as far as it will go. This motion will override the locking mechanism compressing the coilspring and flat steel spring. When the knob is released the locking bar will automatically engage itself.

C. The present invention is also unique in its mounting features, as most cabinet doors and drawers have a round knob which can be utilized with the present invention. Most round door knobs have a standard 10–32 thread. By removing the existing door knob and screw which holds the knob on the door, exposing a hole in the door or drawer, depending on the location of the existing hole in the door or drawer, the hole can be enlarged to accommodate the lock stem. If a new hole must be drilled for the proper distance from the center of the lockstem to the door or drawer frame to rest the locking bar properly behind door frame, the old hole can be filled with a wooden plug or a woodfiller. The lock then is simply mounted with two wood screws from the inside of the door or drawer.

D. The present invention has other valuable features not found in existing locks. It can be mounted on right hand doors as well as left hand doors. Being mounted on doors in a horizontal position, the locking bar can be engaged on either side of the lock. It can be mounted on drawers simply by mounting the lock in a vertical position.

DESCRIPTION OF THE DRAWINGS

A better understanding of the present invention will be had by reference to the accompanying drawings wherein like numerals refer to like parts throughout the several views and in which.

DESCRIPTION OF THE PREFERRED EMBODIMENT

Figure 1:
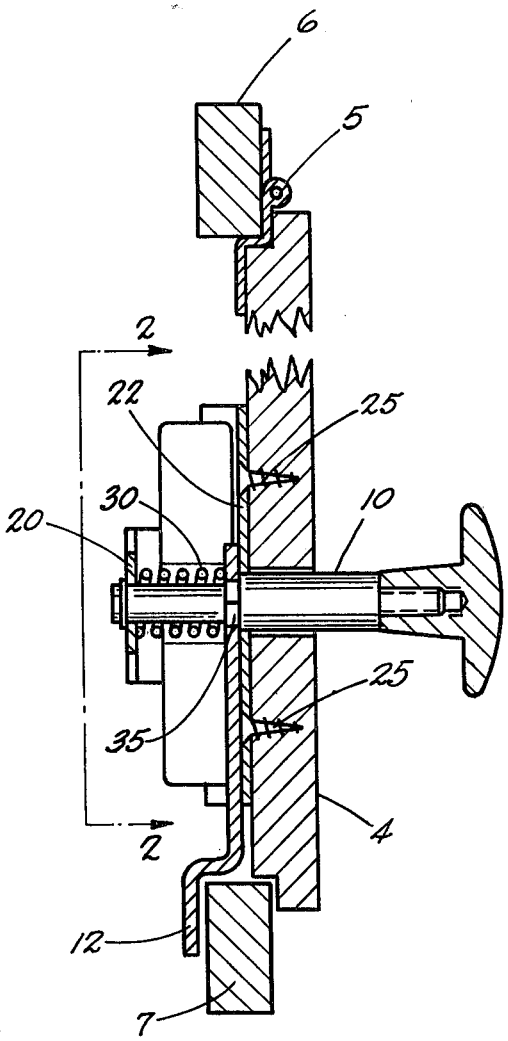
FIG. 1 is a fragmentary view in horizontal section, partly broken away and shown in plan, of my safety lock applied to a cabinet door. The lock is being shown in a locked position.
Figure 3:
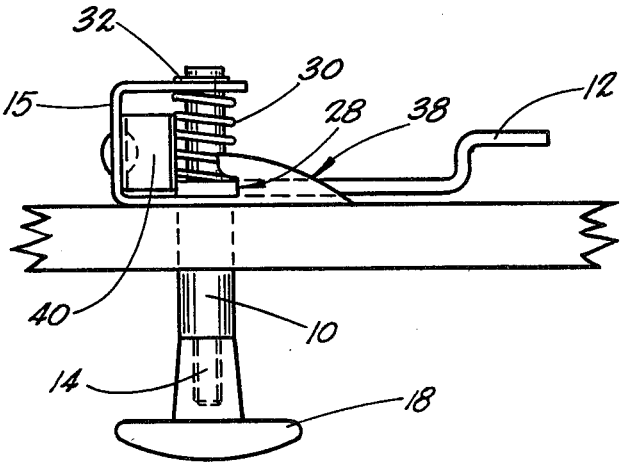
FIG. 3 is a view in vertical section, the locking bar being in an open position, taken on the line 3—3 of FIG. 2.

With reference to FIG. 1, there is shown a cabinet door 4 hinged at one edge, as at 5, to one side of the door frame 6 for closing against the door stop 7 of the frame.

My invention comprises a cylindrical lock stem 10 extending through the door 4 transversely thereof, with an inner locking bar 12 disposed between the lock housing 15. The lock stem 10 is endwise slidable and rotatable in the door 4 through the inside bearing plates 20, 22 of lock housing 15, which is secured to the inside of the door 4 by screws 25. The locking bar 12 extends radially from the lock stem 10 and is adapted to engage keeper slots 28, FIG. 2.

A coil spring 30 on the lock stem 10 is interposed between the bearing plate 20 and the locking bar 12, urging locking bar 12 into a retracted position.

A retaining ring 32 is adapted at the end of lock stem 10 on the outer bearing plate 20 to relieve friction of locking bar 12 against lock housing 15. Lock stem 10 is provided with a square 35 to accommodate the locking bar 12 and is secured by staking, welding or other mechanical means.

A flat sheet steel spring 40 is attached to lock housing 15 and is attached to said lock housing 15 by a rivet, spot welding or other mechanical means. The sheet steel spring 40 exerts pressure against locking bar 12 urging the locking bar 12 upward into keeper slot 28. The lock stem 10 protruding through the door 4 is provided with a standard 10–32 thread 14 to accept standard door knobs 18. A striking plate 38 is provided on each side of lock housing 15 to override keeper slots 28.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resort to falling within the scope of the invention as claimed.

Figure 2:
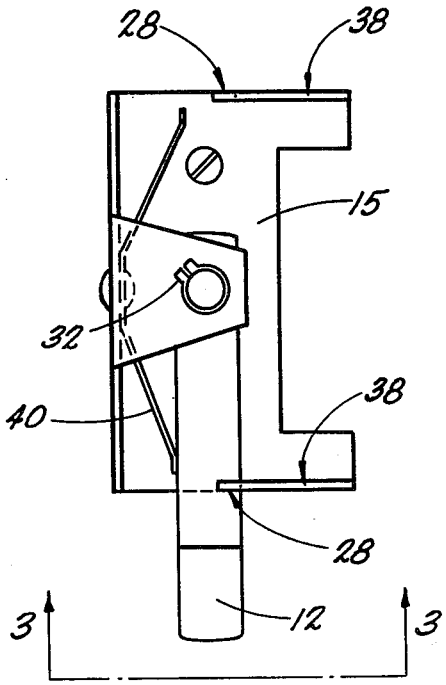
FIG. 2 is a top view of the lock portion, taken on the lone 2-2 of FIG. 1, shown in a locked position.

Referring now to the operation of the lock, the lock is in a locked position as viewed in FIG. 2, and the door knob 18 is rotated counterclockwise, being mounted on a right hand door as viewed in FIG. 1. As soon as the locking bar 12 has been rotated out of keeper slot 28, flat steel spring 40 is compressed exposing locking bar 12 for lateral motion. By exerting pressure against the door knob 18, locking bar 12 exerts pressure against coilspring 30, which clears locking bar 12 to override striking plate 38. With a clockwise rotation locking bar 12 is moved into a vertical position, approximately 90°. The door is now readily opened.

In order to lock the door, the door knob 18 is rotated counterclockwise, causing locking bar 12 to override striking plate 38, compressing coil spring 30. Continuing counterclockwise motion of locking bar 12 exerts pressure against flat steel spring 40, such that locking bar 12 is rotated as far as it will go. Then the door-knob is released.

The urging of spring pressure vertically and laterally, will urge locking bar 12 to automatically engage itself into keeper slot 28 and the door is now locked.

What is claimed is:

1. A combination door handle and locking device comprising: '(a) a locking portion comprising a stem adapted to be received in an opening in a door or drawer to be locked and an elongated locking element connected to one end of said stem and projecting outward of said stem;

(b) a handle portion on said stem spaced from said locking element;

(c) a lock housing comprising spaced apart bearing plates having aligned openings therein, said stem being received in said openings of said bearing plates so as to be rotatable and slidable therein, a striking plate and adjacent keeper slot on at least one end of said lockhousing and positioned so that said locking element must override said striking plate in a radial motion as said stem is rotated before entering a locked position in said keeper slot; and (d) biasing means operatively associated with said stem and said locking element for urging said locking element into said keeper slot upon said locking element passing over said striking plate and for causing pressure in substantially orthogonal directions against said locking element when in a locked position in said keeper slot.

2. The combination door handle and locking device as defined in claim 1, further including another striking plate and adjacent keeper slot on another end of said lockhousing and positioned so that said locking element must override said striking plate in a radial motion as said stem is rotated before entering a locked position in said keeper slot.

3. The combination door handle and locking device as defined in claim 1 or claim 2, wherein said biasing means comprises a coil spring encircling said stem and a flat metal spring adjacent said keeper slot.

4. The combination door handle and locking device as defined in claim 1, wherein said stem is slidable and rotatable with a portion thereof protruding through the door to accommodate a knob by means of interengaging threads on said stem portions and said knob.

5. The combination door handle and locking device as defined in claim 2, wherein said locking element is rigidly attached to said stem and may be displaced to either side of said lock housing upon rotation of said stem.

6. The combination door handle and locking device as defined in claim 3, wherein said flat metal spring is rigidly mounted at the bottom center of the lock housing, said flat metal spring having portions extending outward at an angle toward each side of said lock housing and adjacent to said receiving slots.

7. The combination door handle and locking device as defined in claim 3, wherein said coil spring is disposed between one of said bearing plates on said lock housing and said locking element.

8. The combination door handle and locking device as defined in claim 1, wherein said striking plate extends at about 90° from one of said bearing plates on said lock housing.

9. The combination door handle and locking device as defined in claim 1, wherein said striking plate extends outward from one of said bearing plates, said striking plate being formed with a gradually sloping side and a vertical side wherein both sides extend toward the other of said bearing plates.

10. The combination door handle and locking device as defined in claim 9, wherein said striking plate is formed with said keeper slot recessed into the bottom of the vertical side adjacent to said one bearing plate.

11. The combination door handle and locking device as defined in claim 10, wherein the junction of said keeper slot and said vertical side is curved for easier retraction of said locking element from said slot.

* * * * *